US005205651A

United States Patent [19]

Decottignies et al.

[11] Patent Number: 5,205,651

[45] Date of Patent: Apr. 27, 1993

[54] CONTAINER MADE OF SYNTHETIC MATERIAL WITH IMPROVED RIGIDITY

[75] Inventors: Laurent Decottignies; Daniel Chatourel, both of Vittel, France

[73] Assignee: Société Generale des Eaux Minerales de Vittel, Vittel, France

[21] Appl. No.: 846,819

[22] Filed: Mar. 6, 1992

Related U.S. Application Data

[62] Division of Ser. No. 499,330, Jul. 26, 1990, Pat. No. 5,097,651.

[30] Foreign Application Priority Data

Sep. 26, 1988 [FR] France ..... 88 12717

[51] Int. Cl.[5] ..... B65D 33/02

[52] U.S. Cl. ..... 383/119; 53/456; 229/87.01; 493/210; 493/217

[58] Field of Search ..... 383/109, 119; 493/210, 493/217; 53/463, 450, 451, 456, 463; 229/87.01, 87.18, 87.19

[56] References Cited

U.S. PATENT DOCUMENTS

| | | | |
|---|---|---|---|
| 2,342,324 | 2/1944 | Allen | 383/119 |
| 3,249,286 | 5/1966 | Palmer | 383/109 |
| 4,223,709 | 9/1980 | Myklebust | 383/119 |
| 4,253,507 | 3/1981 | Williamson | 383/119 |
| 4,781,475 | 11/1988 | La Fleur | 383/119 |
| 4,835,037 | 5/1989 | Beer | 383/109 |
| 4,903,859 | 2/1990 | Derby et al. | 383/119 |
| 4,941,755 | 7/1990 | Cazes | 383/119 |

FOREIGN PATENT DOCUMENTS

| | | | |
|---|---|---|---|
| 1959284 | 1/1978 | Fed. Rep. of Germany | 229/87.18 |

*Primary Examiner*—Stephen P. Garbe
*Attorney, Agent, or Firm*—Weiser & Associates

[57] ABSTRACT

The stiffness of a flexible, substantially parallelepipedal container formed by shaping and welding a film which is made of a synthetic material and which is to enclose a liquid to be packaged, is improved by applying, before shaping, a second layer of a film formed of an identical or a different material, as a top film, to the surface of the film forming the container which does not subsequently come into contact with the liquid to be packaged. The top film includes a plurality of strips corresponding to the vertical surfaces of the final container which are welded to the film forming the container before shaping, along lines corresponding to the edges of the final parallelepipedal container.

8 Claims, 3 Drawing Sheets

FIG. 2
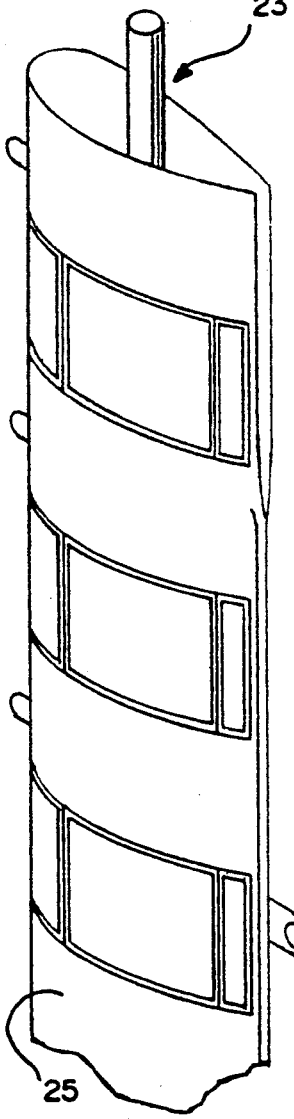
FIG. 3A
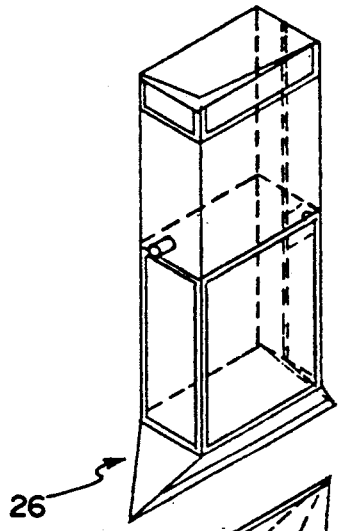
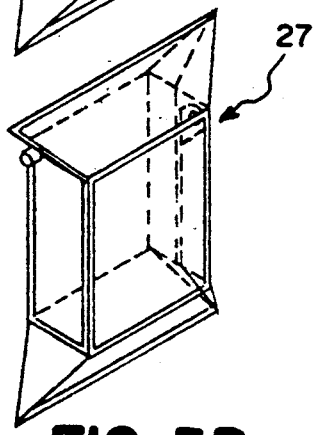
FIG. 3B
FIG. 3C
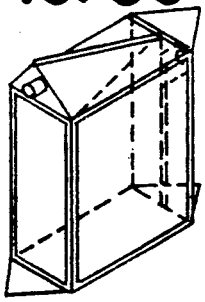
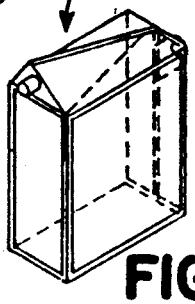
FIG. 3D

CONTAINER MADE OF SYNTHETIC MATERIAL WITH IMPROVED RIGIDITY

This is a division of application Ser. No. 07/499,330, filed Jul. 26, 1990 now U.S. Pat. No. 5,097,651.

BACKGROUND OF THE INVENTION

The present invention relates to a process and a device for improving the stiffness of a substantially parallelepipedal container made of a synthetic material, the said container being obtained by shaping and weldings from a film which is made of the said synthetic material and is to enclose the liquid to be packaged.

It also relates to containers obtained in this way.

Processes and devices of this type are already generally known per se.

They have, for example, but not in a limiting way, been the subject of patents and/or patent applications filed by the Applicant.

Thus in French Patent 2,554,785 a process has been proposed for attaching a stiff or semi-stiff handle to a carton made of a flexible synthetic material. This process is still relatively complex to implement because of compatibility problems between the different materials used. Moreover the stiffening is strictly linked to the grip and the said stiffening is not uniformly ensured over all the surfaces.

In French Patent 2,577,893 filed by the Applicant it has been proposed to equip a flexible bag with rigid stiffening and stabilization means, specifically ribs formed from the material of the film. The implementation of this process in industry remains difficult.

In French Patent Application 2,611,163, also filed by the Applicant, it is envisaged to shape a bag filled with thc liquid to be packaged and then to enclose the said bag and to shape it with a sleeve made of a synthetic material which can be drawn, said sleeve being cold-formed by jaws capable of translational movement and at a distance from each other. This device is satisfactory but can be improved as regards the sequence of operations since in this case the stiffening has an effect on the bag which is already filled, this being a source of potential problems for the container of the said bag.

SUMMARY OF THE INVENTION

The object of the invention is to overcome these disadvantages of the prior art by proposing a process and a device making it possible for a substantially parallelepipedal container to be obtained which is stiffened uniformly over its four vertical surfaces.

According to the invention this objective is achieved with a process for improving the stiffness of a flexible, substantially parallelepipedal container which has been obtained by shaping and weldings from a film which is made of the said synthetic material and is to enclose the liquid to be packaged, characterized in that it comprises applying, before shaping, to the surface of the said film which does not subsequently come into contact with the liquid to be packaged a second layer of a film of identical or different material, referred to as top film, the said top film comprising a plurality of strips corresponding to the vertical surfaces of the final carton, the said strips being welded to the said film, before its shaping, along lines corresponding to the edges of the final parallelepipedal container.

The invention also relates to a device for the implementation of the said process, said device being characterized in that it comprises, in an apparatus for shaping a first film of flexible synthetic material to give containers, a second apparatus supplying top film unwinding perpendicular or parallel to the said first film, the said second film being applied to the first film by means of longitudinal and transverse weld seams corresponding to the edges of the final parallelepipedal container.

The top film can advantageously be printed and will function as a label.

BRIEF DESCRIPTION OF THE DRAWINGS

The invention will be better understood by means of the description which follows of an embodiment given by way of non-limiting example, reference being made to the attached drawings in which:

FIG. 2 is an illustration of the shaping of a film obtained by the processes illustrated in FIGS. 1*a* and 1*b*

FIG. 3 illustrates the subsequent stages, namely:

FIG. 3A: filling, then transverse welding and cutting,

FIG. 3B: carton before final shaping,

FIG. 3C: formation of the horns and cut-offs of the latter,

FIG. 3D: final structure of the container.

DETAILED DESCRIPTION OF THE INVENTION

Figure 1A:
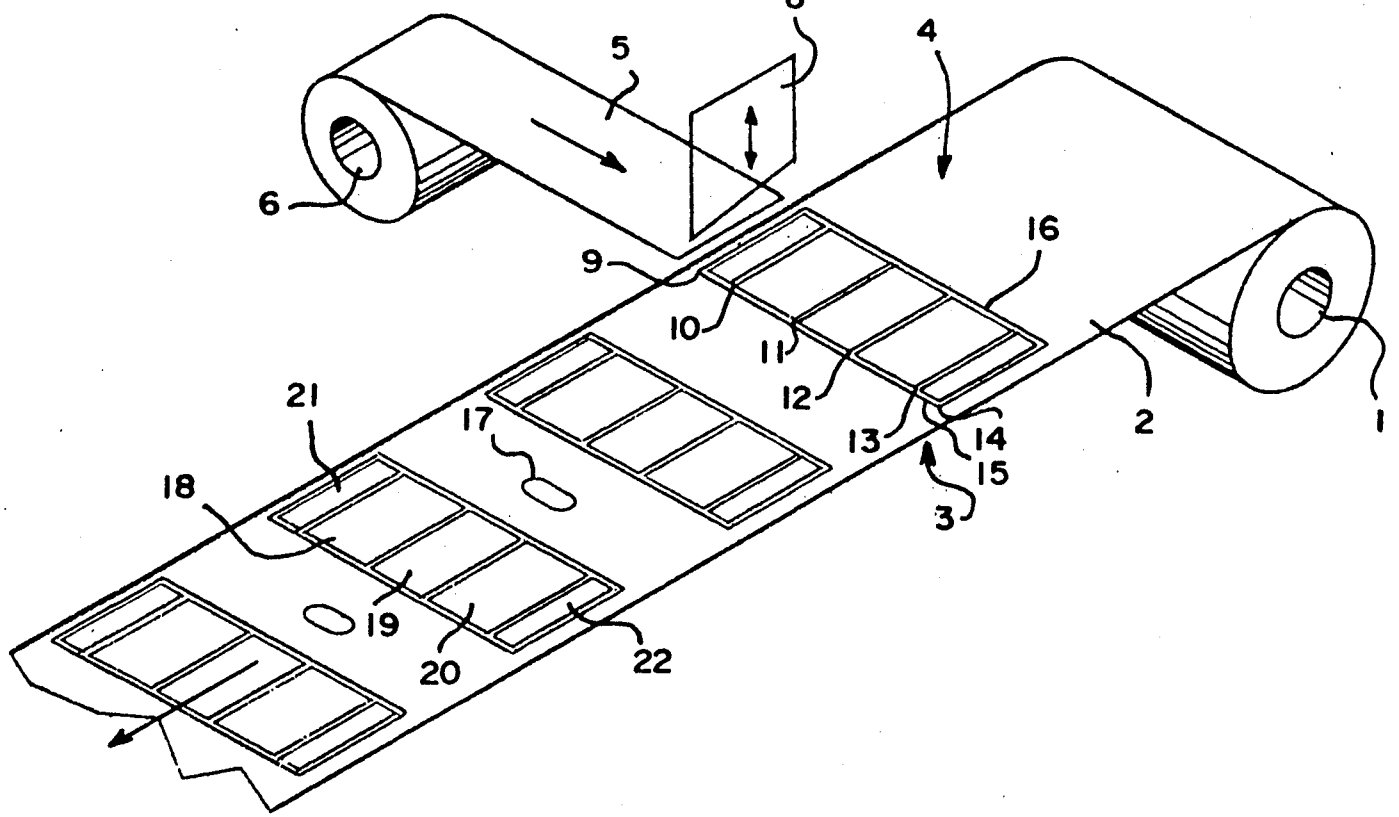
FIGS. 1*a* and 1*b* are diagrammatic views of two variant embodiments of the process according to the invention.
Figure 1B:
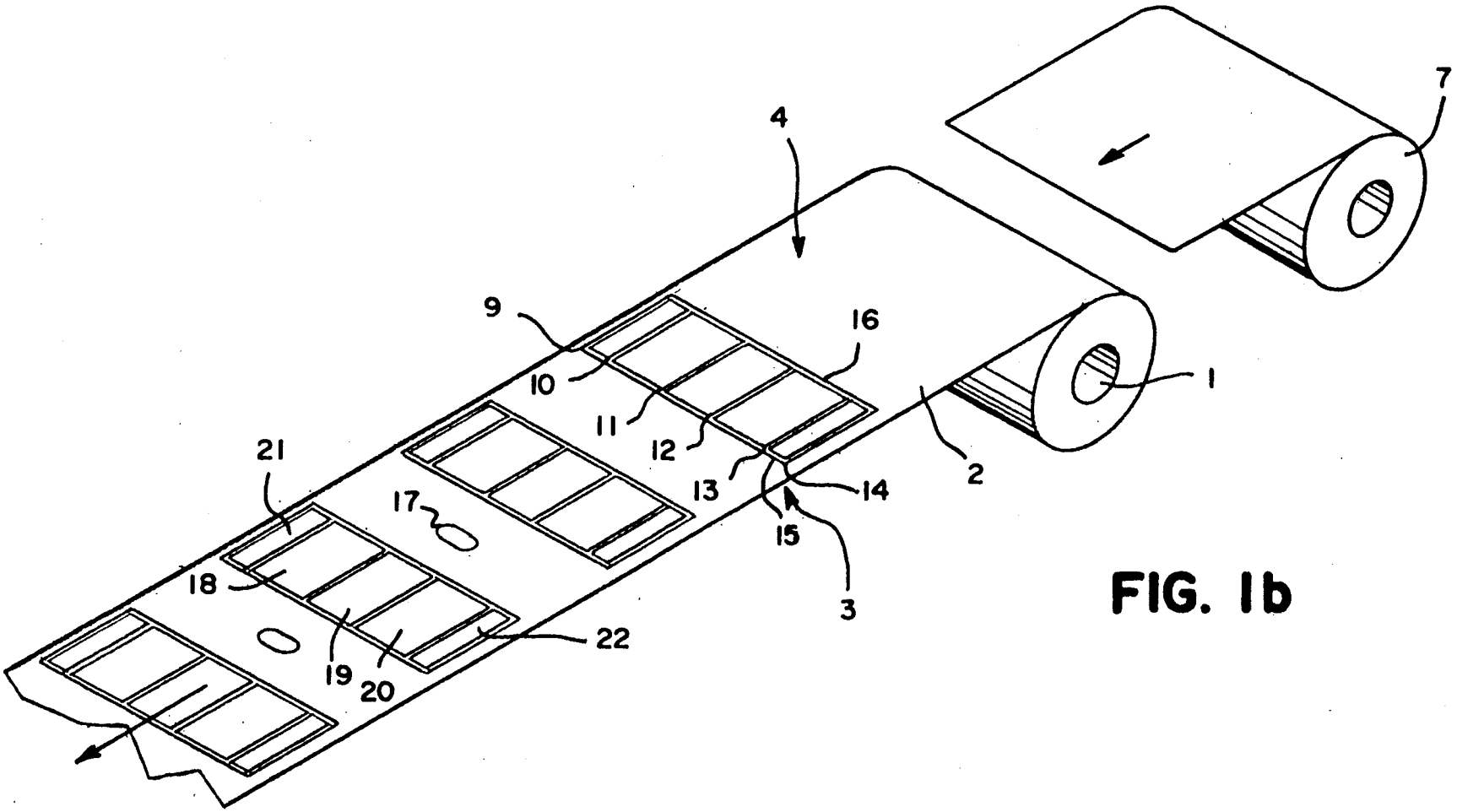

Reference will first be made to FIGS. 1*a* and 1*b*.

A reel (1) of the main film (2) is shown, the "lower" surface (3) of which will come into contact with the liquid to be packaged.

A top film (5) unwound from a spool unwinding, like (6), perpendicular to the travel of the film (2) as shown in FIG. 1*a* or, like (7), parallel to the travel of the said film (2) as shown in FIG. 1*b*, is applied to the "upper" surface (4).

The top film (5) is placed on the film (2), cut by an apparatus (8) shown diagrammatically, and welded onto the said film along longitudinal lines (9, 10, 11, 13, 14) and two transverse lines (15, 16).

All these operations are carried out in a stepwise manner so that there takes place, in succession, forward movement of the film (2), forward movement of the film (5), cutting of the required length of strip, welding of the different lines, and then forward movement of the film (2) again.

Downstream there is envisaged the positioning of a stopping plug (17), for example as described in French Patent 2,600,974 filed by the Applicant.

The film (2) equipped with its top film and weld seams (9, 14) and defining three main panels (18, 19, 20) and two lateral half-panels (21, 22) is then conveyed onto a shaping apparatus (23) shown in FIG. 2.

This shaping apparatus is of the type described in French Patent 2,554,785 filed by the Applicant and will therefore not be described in more detail.

The panels delimited by the vertical weld seams define the vertical surfaces of the final container. The lateral half-panels will be welded together and, in this instance, will be able to grasp a gripping ring (24) of the final container.

The two lateral half-panels (21, 22) are therefore connected together and form a surface of the final carton by means of vertical welding on the shaping apparatus (23).

Filling of the receptacle shaped in this way (25), transverse welding and cutting at (26), shown in FIG. 3A, to produce the unit (27) of FIG. 3B then take place in a conventional manner.

The horns are now shaped by welding/cutting in accordance, for example, with French Patent 2,566,321 filed by the Applicant (FIG. 3C), so as to obtain the final package (28) shown in FIG. 3D.

It will be noted that the apparatus functions in a sequential and stepwise manner.

Between each strip of top film applied to the main film there is an area on which the stopping plug is fitted and which will serve, in combination for this purpose with the preceding strip, for the formation of the base, the top and the horns of the container.

We claim:

1. A flexible container of improved stiffness and shaped as a parallelepiped for enclosing a liquid to be packaged, produced according to a process comprising the steps of:

drawing a first plastic film from a first supply;

drawing a second plastic film from a second supply so that the second film is caused to overly a first surface of the first film;

securing the second film to the first film by welding the second film to the first film along a plurality of spaced lines for defining edges of the formed container; and thereafter, forming the container from the welded films so that the first surface of the first film, and the second film, form outer portions of the container which will not subsequently come into contact with a contained liquid and so that the welding lines delineate a plurality of strips defining vertical panels of the formed container.

2. The container of claim 1 wherein one of the vertical panels is comprised of two lateral half-panels welded together.

3. The container of claim 1 wherein the first film is formed of a synthetic material.

4. The container of claim 3 wherein the second film is formed of a synthetic material which is identical to the synthetic material which forms the first film.

5. The container of claim 3 wherein the second film is formed of a synthetic material which is different from the synthetic material which forms the first film.

6. A flexible container of improved stiffness and shaped as a parallelepiped for enclosing a liquid to be packaged, produced according to a process comprising the steps of:

drawing a first plastic film from a first supply;

drawing a second plastic film from a second supply so that the second film is caused to overly a first surface of the first film;

securing the second film to the first film by welding the second film to the first film along a plurality of spaced lines for defining edges of the formed container; and delivering the secured first and second films to means for forming the container and forming the container from the welded films so that the first surface of the first film, and the second film, form outer portions of the container which will not subsequently come into contact with a contained liquid, and so that the welding lines delineate a plurality of strips defining vertical panels of the formed container.

7. The container of claim 6 wherein each of the plurality of strips is delineated by the welding lines.

8. The container of claim 6 wherein each of the edges of the formed container is defined by one of the spaced lines welding the first film to the second film.

* * * * *